United States Patent [19]

Ueda

[11] 4,286,382

[45] Sep. 1, 1981

[54] SLIDER APPLICATOR FOR SLIDE FASTENERS

[75] Inventor: Minoru Ueda, Kurobe, Japan

[73] Assignee: Yoshida Kogyo, K.K., Japan

[21] Appl. No.: 107,382

[22] Filed: Dec. 26, 1979

[30] Foreign Application Priority Data

Dec. 29, 1978 [JP] Japan ..... 53-162848

[51] Int. Cl.[3] ..... B23P 19/00; A41H 37/06

[52] U.S. Cl. ..... 29/768

[58] Field of Search ..... 29/33.2, 408, 409, 766, 29/768

[56] References Cited

U.S. PATENT DOCUMENTS

| | | | |
|---|---|---|---|
| 3,600,786 | 8/1971 | Hansen | 29/768 |
| 3,629,926 | 12/1971 | Maeda | 29/768 |
| 3,714,698 | 2/1973 | Fukuroi | 29/408 |
| 3,792,521 | 2/1974 | Kawakami | 29/768 X |
| 3,875,647 | 4/1975 | Yoshida | 29/408 |
| 3,973,312 | 8/1976 | Douri et al. | 29/768 |

*Primary Examiner*—Ervin M. Combs

*Attorney, Agent, or Firm*—Robert E. Burns; Emmanuel J. Lobato; Bruce L. Adams

[57] ABSTRACT

A slider applicator includes a rocker housing pivotally mounted on a support frame for angular movement in a plane transverse of a path of travel of a slide fastener stringer to which a slider is to be applied. The rocker housing supports a support rod on which a slider holder is mounted, the slider holder receiving a slider from a chute when the rocker housing is in a horizontal position. The slider holder is turnable about the axis of the support rod through a train of bevel gear during the angular movement of the rocker housing, so that the slider supported on the slider holder will be oriented for attachment to the stringer when the slider holder reaches its vertical position. Means is mounted on the support frame for adjusting the orientation the slider will have upon the slider holder being in the vertical position.

17 Claims, 9 Drawing Figures

SLIDER APPLICATOR FOR SLIDE FASTENERS

BACKGROUND OF THE INVENTION

Field of the Invention

The present invention relates to a slider applicator for slide fasteners.

SUMMARY OF THE INVENTION

A slider applicator of the present invention includes a rocker housing rotatably supported on a support frame for angular movement in a plane perpendicular to the path of travel of a slide fastener stringer to which a slider is to be applied. The rocker housing supports a rod extending therethrough for longitudinal movement and supporting on one end a slider holder which receives and holds a slider during the angular or swinging movement of the rocker housing. The slider holder itself is angularly moved or turned about the axis of the rod by a pair of bevel gears while the rocker housing is being angularly moved. Thus, the slider makes a combined swinging and turning movement so as to be brought from a slider supplying position to a position ready for attachment to the slide fastener stringer. The gear ratio between the bevel gears is so selected that when in the latter position, the slider is inclined at an angle to the path of the slide fastener stringer. Means is provided for allowing the bevel gears to remain nonrotatable relatively to each other for an adjustable angular extent.

It is an object of the present invention to provide a slider applicator for supplying a slider to a slider applying position along a path of supply extending transversely of the path of travel of a slide fastener stringer.

Another object of the present invention is to provide a slider applicator having means for enabling a slider to be swung and turned about mutually perpendicular axes, respectively, before reaching a predetermined slider applying position.

These and other objects, features and advantages of the present invention will become apparent from the detailed description when taken in conjunction with the accompanying drawings which illustrate a preferred embodiment by way of example.

DETAILED DESCRIPTION OF THE PREFERRED EMBODIMENT

Figure 1:
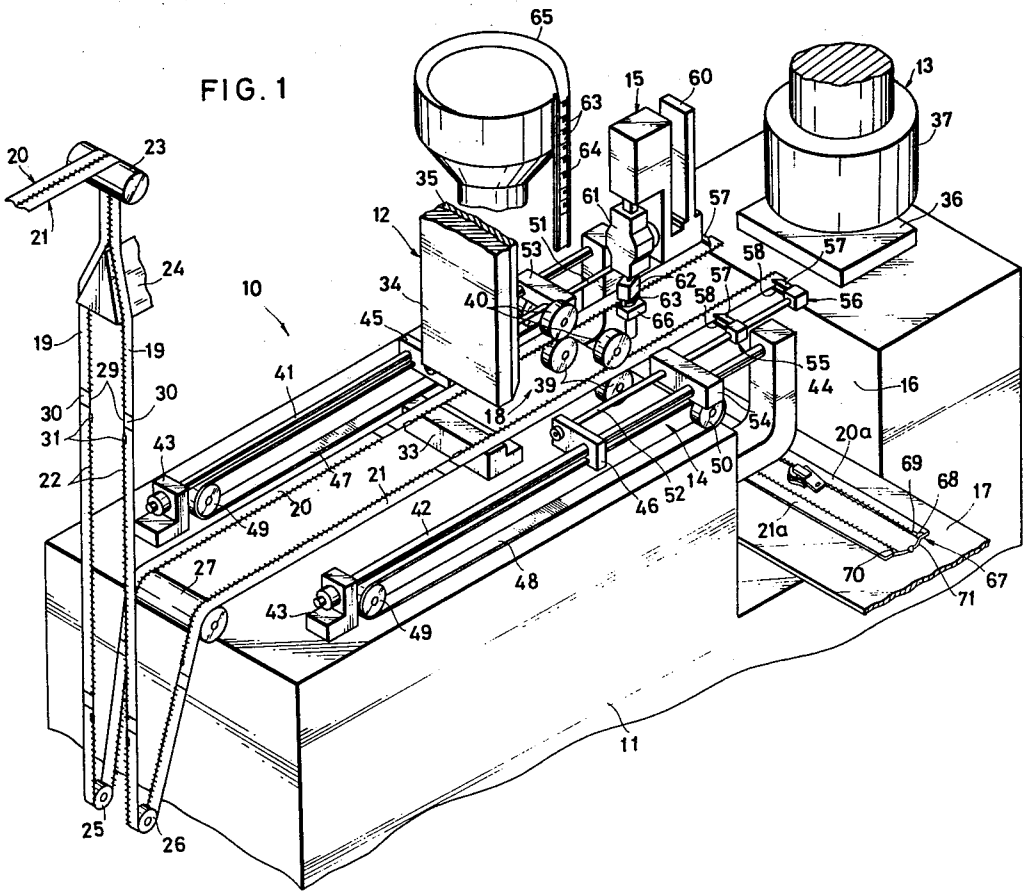
FIG. 1 is a schematic isometric view of an apparatus incorporating a slider applicator according to the present invention.

The principles of the present invention are particularly useful when embodied in a slider applicator 15 incoprorated in an apparatus such as shown in FIG. 1, generally indicated by the numeral 10.

The apparatus 10 generally comprises, in addition to the slider applicator 15, an elongated base 11, a combined cutter, presser and punch 12, a molding device 13, a driving roller assembly 18, and a gripping and feeding device 14, the slider applicator 15 and the driving roller assembly 18 being located between the combined cutter, presser and punch 12 and the molding device 13. The base 11 has a transverse slot 16 adjacent to the molding device 13, and a discharge table 17 disposed in the slot 16.

A pair of continuous slide fastener stringers 20,21 are interengaged initially prior to being fed into the apparatus 10, and each include a row of coupling elements 22 mounted on and along a longitudinal edge of a stringer tape 19. Each slide fastener stringer 20,21 also has a plurality of longitudinally spaced element-free gaps or spaces 29, a plurality of reinforcing films 30 of synthetic resin applied to the stringer tape 19 at the element-free gaps 29, and a plurality of top end stops 31 attached to the tape 19 adjacent to the films 30. The interengaged slide fastener stringers 20,21 are supplied from a bobbin (not shown), are guided around a roller 23, are separated from each other by a separator or splitter 24, and then are tensioned by a pair of vertically movable tension rollers 25,26, respectively, after which the stringers 20,21 are fed around a roller 27 rotatably mounted on the base 11 onto the base 11 along a longitudinal path thereon.

The combined cutter, presser and punch 12 comprises a lower member or die 33 fixed to the base 11, a tape presser 34 and a cutter blade 35, the latter two being vertically movable toward and away from the die 33. When lowered, the tape presser 34 presses the stringer tapes 19,19 down against the die 33, and the cutter blade 35 coacts with the die 33 for severing the stringer tapes 19,19.

The molding device 13 includes a lower mold 36 mounted on the base 11, and an upper mold 37 vertically movable toward and away from the lower mold 36. The upper mold 37, upon engagement with the lower mold 36, molds a separable end stop 67 of synthetic resin on the slide fastener stringers 20,21 by injection molding. The separable end stop 67 is composed of a box member 68 with a pin 69 and a pin member 70 which are formed on the films 30 at the leading ends of stringer pieces **20*a*,21*a*, respectively, cut off by the cutter blade 35. The stringer pieces 20*a*,21*a* with the separable end stop 67 thus molded are thrown out onto the discharge table 17**, and will be finished into a completed slide fastener by removing any runners from the molded part.

The driving roller assembly 18 includes two pairs of drive and pinch rollers 39,40. Each drive roller 39 is rotatively driven by a motor (not shown) housed in the base 11, and each pinch roller 40 is vertically movable toward and away from the drive roller 39. The slide fastener stringers 20,21 are advanced by the respective two pairs of drive and pinch rollers 39,40 held together.

The gripping and feeding device 14 includes a pair of parallel rails 41,42 extending longitudinally of the base 11 and each supported by a pair of brackets 43,44 mounted on the base 11, a pair of slides 45,46 slidably mounted on the rails 41,42, respectively, and connected to a pair of longitudinally reciprocable endless belts 47,48 each stretching around a pair of drive rollers 49,50 drivably mounted on the base 11. A pair of longitudinal rods 51,52 are fixed to the slides 45,46, respectively, there being a pair of auxiliary slides 53,54 slidable along the rails 41,42 and supporting the rods 51,52, respectively. A pair of longitudinally spaced grip assemblies 55,56 are supported on each of the rods 51,52. Each of the grip assemblies 55,56 comprises a pair of grip arms 57,58 movable toward each other for gripping one of the stringer tapes 19 therebetween.

The slider applicator 15 comprises a rocker housing 61 rotatably supported on a support frame 60 for angular movement in a plane perpendicular to the path of travel of the slide fastener stringer 20, and a slider holder 62 mounted on the rocker housing 61 for receiving a slider 63 from a vertical chute 64 extending downwardly from a slider feeder 65 and for holding the slider 63 during angular movement of the rocker housing 61. A fixed slider support 66 cooperates with the slider holder 62 for supporting the slider 63 in the longitudinal path of one of the slide fastener stringers 20 so as to be ready for attachment thereto.

Figure 4:
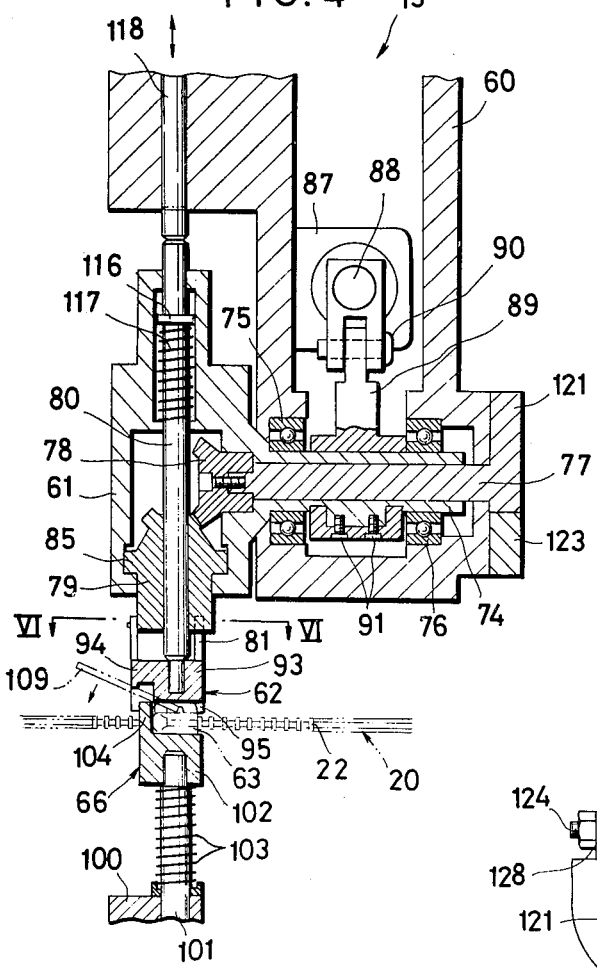
FIG. 4 is a cross-sectional view taken along line IV—IV of FIG. 2.
Figure 6:
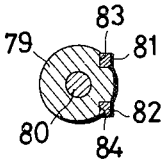
FIG. 6 is a cross-sectional view taken along line VI—VI of FIG. 4.

As shown in FIG. 4, a hollow cylindrical shaft 74 extending from the rocker housing 61 is rotatably supported on the support frame 60 by a pair of bearings 75,76 and extends in a direction that is parallel to the path of movement of the slide fastener stringers 20,21. A horizontal axle 77 is rotatably disposed in the hollow shaft 74 and has on one end a first bevel gear 78 that is in driving mesh with a second bevel gear 79 having an annular flange 85 journaled in the rocker housing 61. A support rod 80 extends through the rocker housing 61 and the second bevel gear 79 in coaxial relation therewith and in perpendicular relation to the axis of the axle 77. The slider holder 62 is secured to one end of the support rod 80, and has a pair of pins 81,82 (FIG. 6) extending longitudinally of the rod 80 and slidably received respectively in a pair of slots 83,84 in the second bevel gear 79. Accordingly, the support rod 80 is longitudinally slidable with respect to the second bevel gear 79 but is corotatable therewith.

Figure 2:
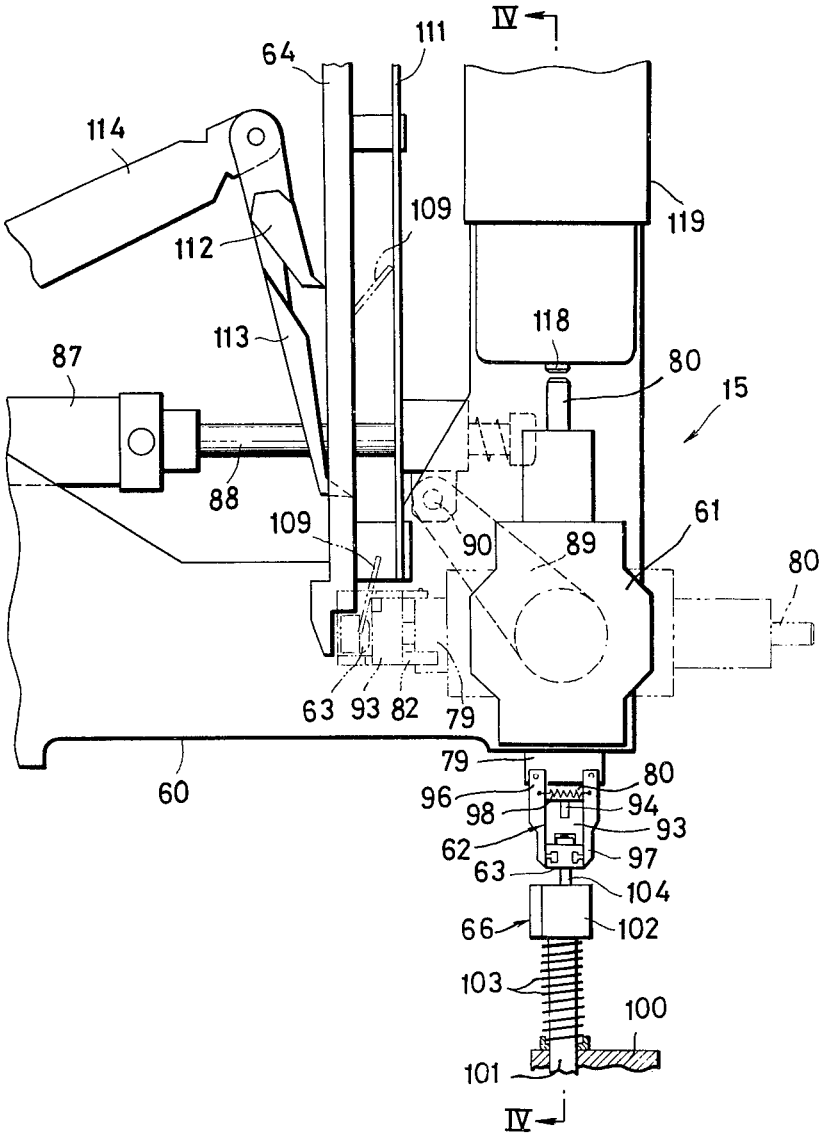
FIG. 2 is an enlarged front elevational view of the slider applicator.
Figure 3:
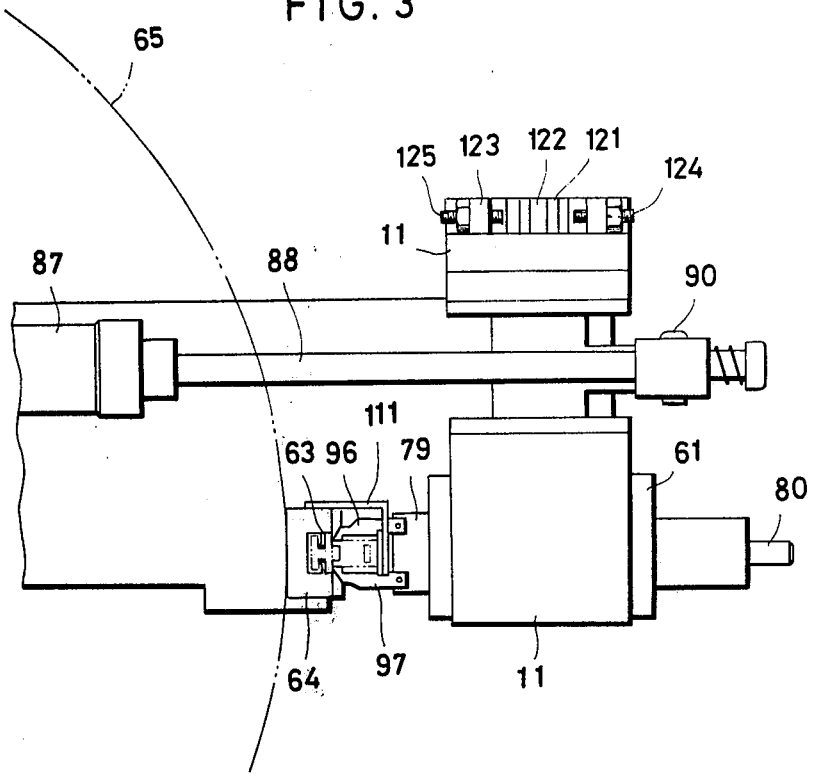
FIG. 3 is a plan view of the slider applicator.

In FIGS. 2, 3 and 4, a fluid-pressure actuator 87 supported on a non-illustrated frame has a piston rod 88 coupled with a link 89 pivotally by a pin 90, the link 89 being secured to the hollow cylindrical shaft 74 by a pair of screws 91,91. The rocker housing 61 is angularly movable about the axis of the shaft 74 between horizontal and vertical positions (described later) by extension and contraction of the piston rod 88.

Figure 7:
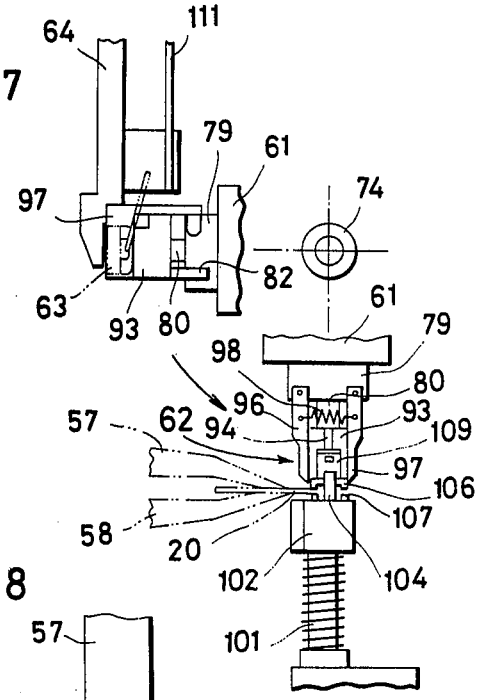
FIG. 7 is a schematic view illustrative of operation of the slider applicator.

As best shown in FIG. 7, the slider holder 62 comprises a body 93 having a nose 94 and a recess 95 (FIG. 4), and a pair of L-shaped grip arms 96,97 pivoted to the second bevel gear 79 and urged toward each other by a spring 98 acting therebetween for resiliently sandwiching a slider 63.

The fixed slider support 66 of FIG. 2 includes a base 100, a longitudinally movable rod 101 projecting vertically from the base 100, a table 102 mounted on the rod 101, and a spring 103 disposed around the rod 101 for urging the table 102 normally upwardly away from the base 100. A lifter pin 104 projects upwardly from the table 102.

Figure 8:
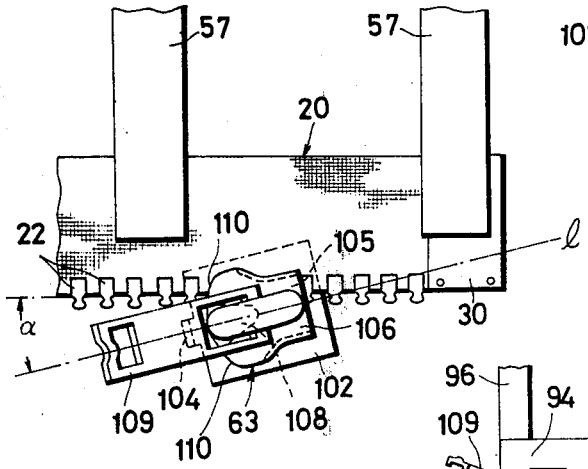
FIG. 8 is an enlarged plan view of a slider which is supported in position and through which a row of coupling elements is being threaded.
Figure 9:
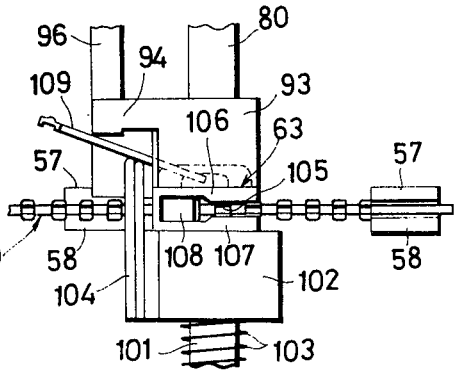
FIG. 9 is an enlarged side elevational view of a slider holder and a slider support jointly holding a slider while a row of coupling elements is being threaded therethrough.

As shown in FIGS. 8 and 9, the slider 63 has a Y-shaped guide channel 105 defined between a pair of upper and lower wings 106,107 interconnected by a separator 108, there being a pull tab 109 pivotally mounted on the upper wing 106. The Y-shaped guide channel 105 includes a pair of throats 110,110 one on each side of the separator 108.

In FIGS. 2 and 3, a vertical guide plate 111 is fixed to and extends along the chute 64 for guiding pull tabs 109 of sliders 63 moving down the chute 64. The sliders 63 are intermittently fed downwardly by a pair of feeding fingers 112,113 pivotally connected to a vertically reciprocable drive arm 114, the sliders 63 having their longitudinal axes extending vertically with the throats 110 opening upwardly.

As illustrated in FIG. 4, the support rod 80 has a flange 116 against which a spring 117 disposed in the rocker housing 61 around the rod 80 acts to normally urge the rod 80 in a direction to move the slider holder 62 toward the second bevel gear 79. The support frame 60 carries a housing 119 (FIG. 2) in which there is mounted a vertically drivable pusher rod 118 with which the support rod 80 is alignable when the rocker housing 61 is held in its vertical position.

Figure 5:
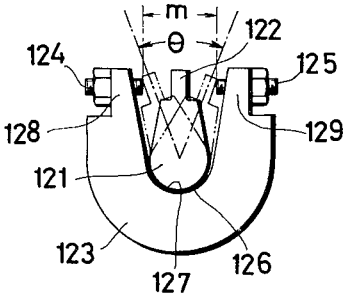
FIG. 5 is a front elevational view of an adjusting device.

In FIGS. 4 and 5, the axle 77 has on its other end remote from the first bevel gear 78 a lever 121 having an abutment 122 and angularly movable in a horseshoe-shaped member 123 mounted on the support frame 60. The horseshoe-shaped member 123 includes a pair of spaced arms 128,129 that carry a pair of respective screws 124,125 coaxial with respect to each other in confronting relation. The lever 121 and the horseshoe-shaped member 123 have respective complemental arcuate surfaces 126,127 that slidably engage each other.

Operation of the slider applicator 15 is as follows: The piston rod 88 is first in its extended position in which the rocker housing 61 is in the horizontal position, as shown by the imaginary lines in FIG. 2, to cause the slider holder 62 to be located just below the end of the chute 64. The endmost one of the sliders 63 which has been supplied from the end of the chute 64 is sandwiched between the grip arms 96,97. At this time, the abutment 122 of the lever 121 engages one of the screws 124. Then, the fluid-pressure actuator 87 is actuated to retract its piston rod 88, causing the rocker housing 61 to swing down from the horizontal position with one of the sliders 63 being carried away by the slider holder 62, toward the vertical position typically through an angle of 90 degrees. During an initial portion of the swinging movement of the rocker housing 61, the axle 77 is allowed to rotate with the hollow shaft 74 because the lever 121 angularly moves away from the screw 124. Thus, the second gear 79 does not turn relatively to the first gear 78, and the slider holder 62 does not move relatively to the rocker housing 61 but merely moves angularly therewith about the axis of the shaft 77 through such initial portion of the swinging movement of the rocker housing 61. When the abutment 122 of the lever 121 against the screw 125, that is, after the lever 121 has moved an angle of $\theta$ (FIG. 5), the axle 77 becomes prevented from moving angularly, whereupon the second gear 79 is caused by continued swinging movement of the rocker housing 61, to revolve in mesh with the first bevel gear 78 being held nonrotatable. The slider holder 62 starts to rotate about the axis of the support rod 80 as it is continuously swung with the rocker housing 61.

When the rocker housing 61 reaches its vertical position shown in FIGS. 2 and 4 at the end of the stroke of the piston rod 88, the slider holder 62 is located immediately above the slider support 66. The gear ratio between the first and second gears 78,79 is so selected that when the slider holder 61 is in the vertical position, the longitudinal axis l (FIG. 8) of the slider 63 is inclined at an angle $\alpha$ to the path of travel of the slide fastener stringer 20, so as to allow the row of coupling elements 22 to enter the guide channel 105 in the slider 63 unobstructedly through one of the throats 110. Thus, the slider 63 has angularly moved through an angle of $90°+\alpha$. With the rocker housing 61 in the vertical position, the actuator rod 118 is actuated to move downwardly into driving engagement endwise with the support rod 80, which is pushed downwardly to press the slider 63 against the table 102 of the slider support 66. The slider 63 is at the time displaced slightly with the lower wing 107 being moved out of engagement with the grip arms 96,97 (FIG. 9), the lower edges of which are then positioned clear of the guide channel 105. The pull tab 109 is displaced by the lifter pin 104 upwardly against the nose 94. The slider 63 is now ready for being applied onto the slide fastener stringer 20 being advanced by the grip arms 57,58.

With this arrangement, a slider 63 can be swung from a lateral supplying position along a path perpendicular to the path of travel of the slide fastener stringer 20 to an applying position that is in the path of the slide fastener stringer, and during such swinging movement, it can also be turned by itself for a predetermined angular extent until the longitudinal axis thereof is inclined to said path for smooth introduction of the row of coupling elements in the slider guide channel. Such a combined swinging and turning movement of the slider is achieved simply by the actuation of the fluid-pressure actuator 87. The angle $\alpha$ (FIG. 8) is adjustable by changing the distance m between the screws 124,125, which can be varied by the turning of the screw 124 or 125 or both.

Upon application of the slider 63 to the slide fastener stringer 20, the drive rod 118 is retracted to allow the support rod 80 to move upwardly under the force of the spring 117, and then the actuator 87 is actuated to withdraw the piston rod 88 until the rocker housing 61 is angularly moved from the vertical to the horizontal position for the reception of a next slider 63. While the rocker holder 61 is being returned, the slider holder 62 is turned back about the axis of the support rod 80. The lever 121 is angularly moved back into engagement with the screw 124 during swinging movement of the rocker housing 61.

Although a certain preferred embodiment has been shown and described in detail, it should be understood that changes and modifications may be made therein without departing from the scope of the invention as defined by the appended claims.

I claim as my invention:

1. A slider applicator for a slide fastener stringer traveling along a longitudinal path, comprising:

(a) a frame;

(b) a rocker housing pivotally mounted on said frame for angular movement in a plane transverse of the path of the slide fastener stringer;

(c) a rod extending through said rocker housing in said plane;

(d) a slider holder mounted on said rod for holding a slider thereon; and (e) gearing means disposed in said rocker housing for enabling said slider holder to be turned about the axis of said rod so as to orient the slider with respect to the path of the stringer upon the angular movement of said rocker housing.

2. A slider applicator according to claim 1, including a hollow cylindrical shaft rotatably mounted on said frame, and said rocker housing being mounted on said hollow cylindrical shaft.

3. A slider applicator according to claim 2, including a fluid-pressure actuator having a piston rod coupled through a link with said hollow cylindrical shaft, said fluid-pressure actuator being actuatable to cause said rocker housing to be angularly moved in said plane.

4. A slider applicator according to claim 1, including an axle extending through said hollow cylindrical shaft for limited corotation therewith, said gearing means comprising a pair of bevel gears meshing with each other, one of said bevel gears being mounted on one end of said axle, and the other bevel gear being rotatably supported in said rocker housing.

5. A slider applicator according to claim 4, said rod extending coaxially through said other bevel gear.

6. A slider applicator according to claim 4, including a lever mounted on the other end of said axle, a pair of adjustable limit members mounted on said frame, said lever having an abutment movable between said limit members upon turning of said axle, whereby said axle can be turned about its axis for an angular extent defined by said adjustable limit members.

7. A slider applicator for a slide fastener stringer, comprising:

(a) a support frame;

(b) a hollow cylindrical shaft rotataby mounted on said support frame and adapted to extend along a longitudinal path of travel of the slide fastener stringer;

(c) a rocker housing mounted on said shaft for angular movement in a plane transverse of said path of the slide fastener stringer;

(d) an axle disposed in said shaft for limited corotation therewith;

(e) a first gear mounted on one end of said axle and disposed in said housing;

(f) a second gear rotatably disposed in said housing and held in mesh with said first gear, said first and second gears having their axes intersecting each other;

(g) a support rod extending through said housing and said second gear in coaxial relation for longitudinal sliding movement and for corotation with said second gear.

(h) means for angularly moving said rocker housing about the axis of said shaft between first and second angular positions; and (i) means on said rod for holding a slider, whereby the slider is angularly movable about the axis of said rod when said housing is angularly moved between said first and second positions.

8. A slider applicator according to claim 7, including adjusting means for allowing said axle to angularly move about its own axis for an adjustable angular extent, with the angular movement of said housing.

9. A slider applicator according to claim 8, wherein said adjusting means includes a pair of adjustable limit members spaced from each other and mounted on said support frame, and a lever fixed to the other end of said axle for angular movement therewith between said adjustable limit members.

10. A slider applicator according to claim 9, wherein said adjustable limit members comprise a pair of screws, respectively, coaxial with each other.

11. A slider applicator according to claim 7, said first and second gears comprising a pair of bevel gears, respectively.

12. A slider applicator according to claim 7, said slider holding means including a pair of pins extending parallel to said rod, said second gear having a pair of slots in which said pins are longitudinally slidably received, whereby said slider holding means is nonrotatable with respect to said second gear.

13. A slider applicator according to claim 7, including means for supporting a slider held by said slider holding means and located in said path of travel when said housing is in its second position.

14. A slider applicator according to claim 13, including means on said support frame for driving said rod longitudinally to enable said slider holding means to press and retain the slider against said slider supporting means when said housing is in its second position.

15. A slider applicator according to claim 14, said drive means including a reciprocable pusher rod, said support rod being alignable with said pusher rod when said housing is in said second position.

16. A slider applicator according to claim 14, including spring means in said housing for normally urging said rod in a direction to move said slider holding means toward said second gear.

17. A slider applicator according to claim 7, said angularly moving means comprising a fluid-pressure actuator having a piston rod coupled through a link with said hollow cylindrical shaft.

* * * * *